US007815057B2

(12) United States Patent
Bush

(10) Patent No.: US 7,815,057 B2
(45) Date of Patent: Oct. 19, 2010

(54) PORTABLE CUE STICK HOLDING APPARATUS

(75) Inventor: Kevin Bush, Lewisville, TX (US)

(73) Assignee: Billiard Bush LLC, Lewisville, TX (US)

( * ) Notice: Subject to any disclaimer, the term of this patent is extended or adjusted under 35 U.S.C. 154(b) by 226 days.

(21) Appl. No.: 12/018,000

(22) Filed: Jan. 22, 2008

(65) Prior Publication Data

US 2009/0186715 A1 Jul. 23, 2009

(51) Int. Cl.
*A47F 7/00* (2006.01)

(52) U.S. Cl. ..... 211/68; 211/14; 24/509

(58) Field of Classification Search ..... 211/68, 211/60.1, 62, 67, 69.1, 14; 273/30; 24/67.7, 24/67.11, 509–511; 473/21, 42, 43
See application file for complete search history.

(56) References Cited

U.S. PATENT DOCUMENTS

| | | | | |
|---|---|---|---|---|
| 69,026 | A | 9/1867 | Richmond | |
| 410,580 | A * | 9/1889 | Crofford | 24/67.7 |
| 481,455 | A | 8/1892 | Worden | |
| 702,523 | A * | 6/1902 | Yawman | 24/67.7 |
| 2,063,289 | A | 12/1936 | Alusas | |
| 2,603,849 | A * | 7/1952 | Epperson | 24/507 |
| 3,727,272 | A * | 4/1973 | Rhodes | 24/300 |
| 4,275,816 | A | 6/1981 | Denton et al. | |
| 4,745,662 | A * | 5/1988 | Chang | 24/67.7 |
| 4,903,929 | A | 2/1990 | Hoffman | |
| 5,072,908 | A | 12/1991 | Lodrick | |
| 5,139,221 | A | 8/1992 | Lodrick | |
| D338,795 | S | 8/1993 | Huang et al. | |
| 5,255,799 | A | 10/1993 | Haynes | |
| 5,457,858 | A * | 10/1995 | Lin | 24/511 |

(Continued)

OTHER PUBLICATIONS www.cuesight.com (Undated but admitted prior art).

(Continued)

*Primary Examiner*—Korie Chan
(74) *Attorney, Agent, or Firm*—Lawrence R. Youst; Kevin S. Afghani

(57) ABSTRACT

A pool clip for detachably connecting to a support surface may include a first clamp holding member for clamping to the support surface, a second clamp holding member for cooperating with the first clamp holding member for clamping to the support surface, a biasing device for biasing the first clamp holding member and the second clamp holding member, and each of the first clamp holding member and the second clamp holding member having a billiard cue holding surface adapted for holding multiple billiard cues of varying diameters and lengths. The first clamp holding member may include an aperture for cooperating with an insert member, and the insert member may include a depression area adapted for cooperating with a cue ball. The first clamp holding member may include an arm member to cooperate with the biasing device so that the first clamp holding member and the second clamp holding member are pivotally connected, and the first clamp holding member may include a handle section to allow a user to pivot the first clamp holding member with respect to the second clamp holding member. The billiard cue holding surface may be concavely curved, and the clamp holding member may include a support holding surface. The support holding surface may be formed from flexible material, and the insert member may be formed from flexible material.

20 Claims, 5 Drawing Sheets

U.S. PATENT DOCUMENTS

| | | | | |
|---|---|---|---|---|
| 5,632,386 | A * | 5/1997 | Gabhart | 211/85.7 |
| 5,657,882 | A * | 8/1997 | Johnson | 211/68 |
| D387,114 | S | 12/1997 | Bliss | |
| 5,954,589 | A * | 9/1999 | Masters | 473/42 |
| 5,957,291 | A | 9/1999 | Whitfield, Sr. | |
| D472,090 | S | 3/2003 | Wing | |
| 6,547,083 | B2 | 4/2003 | Zummo | |
| 6,945,413 | B1 * | 9/2005 | Meyer | 211/68 |
| 7,536,753 | B2 * | 5/2009 | Thomson et al. | 24/67.5 |
| 2003/0218105 | A1 * | 11/2003 | Sones et al. | 248/104 |
| 2007/0193964 | A1 | 8/2007 | Helms | |
| 2008/0156753 | A1 | 7/2008 | Perry | |
| 2008/0197090 | A1 | 8/2008 | Goff | |
| 2009/0294387 | A1 * | 12/2009 | Spencer et al. | 211/68 |

OTHER PUBLICATIONS www.billiards.com (Undated but admitted prior art).
www.pooldawg.com (Undated but admitted prior art).

* cited by examiner

PORTABLE CUE STICK HOLDING APPARATUS

FIELD OF THE INVENTION

The present invention relates to a portable holder for billiard cues. In particular, the present invention relates to a portable holder for billiard cues that may be detachably connected to a table, ledge, or the like.

BACKGROUND

While only a single billiard cue or billiard cue is necessary to play billiards, billiard players are predisposed to their own favorite cues for a variety of reasons. Increasingly, these cues have fancy and elaborate finishes and include coatings and inlays of precious and rare materials. The cues may be easily scratched or damaged. For these reasons, the cues must be handled and stored carefully.

Stationery and wall mounted cue holders are well known. Denton et al U.S. Pat. No. 4,275,816, Worden U.S. Pat. No. 481,455, and Richmond U.S. Pat. No. 69,026 are illustrative of these types of cue holders. While these holders serve their purpose, they have limitations. These holders may not be located near the area of play. Additionally, when players bring their own cues to a match, the stationery holder may not accommodate the number of cues.

Cues are oftentimes rested upright with one end of the floor and the shaft or other end against a wall, table, chair or the like.

Lodrick U.S. Pat. No. 5,072,098 discloses a removable holder to retain a pool cue in an upright position with its butt end on the floor. The holder may be releasably mounted on any support surface such as a table or a bar. While Lodrick provides support members to support the cue, since the shaft is not surrounded, a jarring force on the cue could knock the cue over. Additionally, no provision in the holder is made to cushion the cue from scratches or damage.

Accordingly, there exists a need to provide a portable cue holder that may be transported to a desired site and may be detachably connected to nearly any flat surface for securely retaining a pool cue without scratching, marring or otherwise damaging the cue shaft.

Other patents which are related are described below.

U.S. Pat. No. 5,954,589 to Masters discloses a cue rest for attachment to a suitable support such as the table top includes two opposed jaws with jaw surfaces for engaging opposed sides of the support. The jaws are connected for relative pivotal movement and are spring biased to the clamping position. Each jaw has a manually engageable portion on a side of the pivot axis opposite to the jaw surface and arranged such that the jaws can be moved to the release position by manual squeezing of the manually engageable portions. A generally U-shaped receiving surface is provided on at least one and preferably both of the jaw members, the receiving surface defining an open mouth at an edge of the manually engageable portion opposite to the jaw surfaces for receiving and cradling the cue within the receiving surface.

U.S. Pat. No. D472,090 to Wing discloses a portable pool cue holder.

U.S. Pat. No. D387,114 to Bliss discloses a pool cue holder.

U.S. Pat. No. 5,255,799 to Haynes discloses a portable holder for a billiard cue having a base end and a shaft. The portable holder includes a clamp for removable attachment to a table, ledge or the like. A flexible resilient member is capable of surrounding the circumference of the shaft, so that the base end of the cue may be placed on a floor or other surface and the shaft of the cue may be inserted into the member for retention.

U.S. Pat. No. 6,945,413 to Meyer discloses a rack assembly includes a clamp including first and second members pivotally connected to each other. The first and second members include first and second jaw portions integral therewith, and are selectively engageable with each other for removably attaching to a support surface. The clamp further includes a spring member connected to the first and second members for causing the first member to automatically move to an original position after being pivoted towards the second member. The rack assembly further includes a rack connected to the clamp and extends outwardly therefrom adjacent the first and second members. The rack may be permanently secured to the clamp or may be removably engaged with the clamp via a fastening member.

SUMMARY

A pool clip for detachably connecting to a support surface may include a first clamp holding member for clamping to the support surface, a second clamp holding member for cooperating with the first clamp holding member for clamping to the support surface, a biasing device for biasing the first clamp holding member and the second clamp holding member, and each of the first clamp holding member and the second clamp holding member having a billiard cue holding surface adapted for holding a billiard cue.

The first clamp holding member may include an aperture for cooperating with an insert member, and the insert member may include a depression area adapted for cooperating with a cue ball.

The first clamp holding member may include an arm member to cooperate with the biasing device so that the first clamp holding member and the second clamp holding member are pivotally connected, and the first clamp holding member may include a handle section to allow a user to pivot the first clamp holding member with respect to the second clamp holding member.

The billiard cue holding surface may be concavely curved, and the clamp holding member may include a support holding surface.

The support holding surface may be formed from flexible material, and the insert member may be formed from flexible material.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
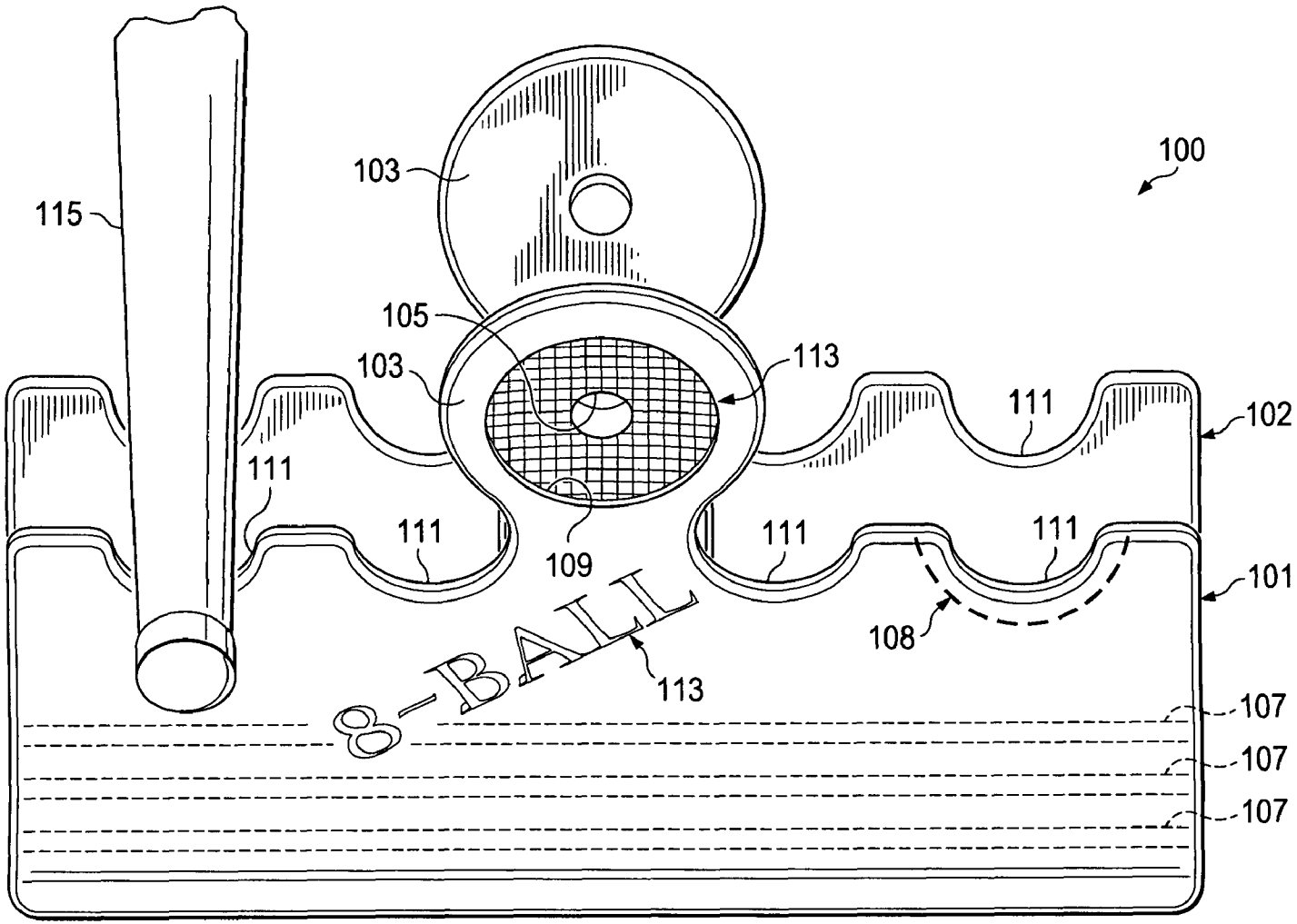
FIG. 1 illustrates a front view of the clamp holding member of the pool clip of the present invention.

It is a principal object and purpose of the present invention to provide a portable cue holder that may be detachably connected to nearly any flat surface.

It is a further object and purpose of the present invention to provide a portable cue holder that is simple and easy to manufacture and assemble.

It is an additional object and purpose of the present invention to provide a portable cue holder that is durable and of high quality yet is attractive and pleasing to the eye.

A portable billiard cue holder is provided which may be secured to a table, ledge or nearly any structure having a flat surface.

The pool clip 100 of the present invention provides many advantages over the above-mentioned prior art. The pool clip 100 can attach to a support surface such as a table or countertop and simultaneously holds multiple pool cues of varying diameters and lengths. The pool clip 100 can easily be attached to any pool case for storage after use.

The pool clip 100 is easy to carry because the pool clip 100 can be clipped onto most pool cases. The pool clip 100 of the present invention is lightweight, adding to the ability to be easily carried around. The pool clip 100 of the present invention can be constructed from and almost unlimited supply of rigid materials such as plastic, metal, fiber, wood or suitable material.

The pool clip 100 of the present invention includes a pair of opposing clamp holding members 101, 102 which are pivotally connected to provide the ability to detachably clamp to a support surface such as varying thickness tables or counters. The surface of the pool clip 100 may be decorated with indicia of custom designs. The pool clip 100 of the present invention includes a flexible surface on the interior of the clamp holding members 101, 102 to increase the frictional hold onto the tables or counters without marring the surface of the table or counters. The flexible surface may be formed from rubber or other suitable flexible material. The pool clip 100 includes a handle section 103 which may include a depression area in order to provide an area to hold a cue ball. The pool clip 100 maintains a firm hold on the billiard cues, preventing the billiard cues from falling and breaking or marring the surface of the billiard cues.

The pool clip 100 includes a biasing device which may be a spring in order to bias the clamp holding member 101 against an opposing clamp holding member 102 in order to provide sufficient holding force on the support surface.

FIG. 1 illustrates the front surface of the clamp holding member 101 which includes a handle section 103 to allow the user to depress the clamp holding member 101 in order to release or a grasp the support surface to which the pool clip 100 will be detachably connected. The handle section 103 is substantially centered and extends in the traverse direction. The handle section 103 includes an aperture 105 which extends through the handle section 103, and the aperture 105 cooperates with an insert member 113 which includes a depression area 109 which may be circular, oval or any other shape in order to accept a personal cue ball to provide a resting position for the cue ball. FIG. 1 additionally illustrates a support holding surface 107 on the backside of the clamp holding member 101, 102 which may be flexible material in order to increase the friction between the support surface and the clamp holding member 101, 102. FIG. 1 further illustrates a billiard cue holding surface 111 which is shown as being concave curved in order to cooperate and clamp the billiard cue 115. FIG. 1 additionally illustrates a billiard cue holding surface 108 which may be formed from flexible material such as rubber or other appropriate material to protect the surface of the billiard cue 115 from being marred. The billiard cue 115 is cooperatively clamped by the opposing billiard cue holding surface 111 of the opposing clamp holding member 102. FIG. 1 illustrates four billiard cue holding surfaces 111 which are adapted to hold four billiard cues 115; however, the teachings of the present invention can be expanded to a pool clip 100 which could hold six or eight or any number of billiard cues 115.

FIG. 1 illustrates optional indicia 113 intended to decorate the pool clip 100.

Figure 2:
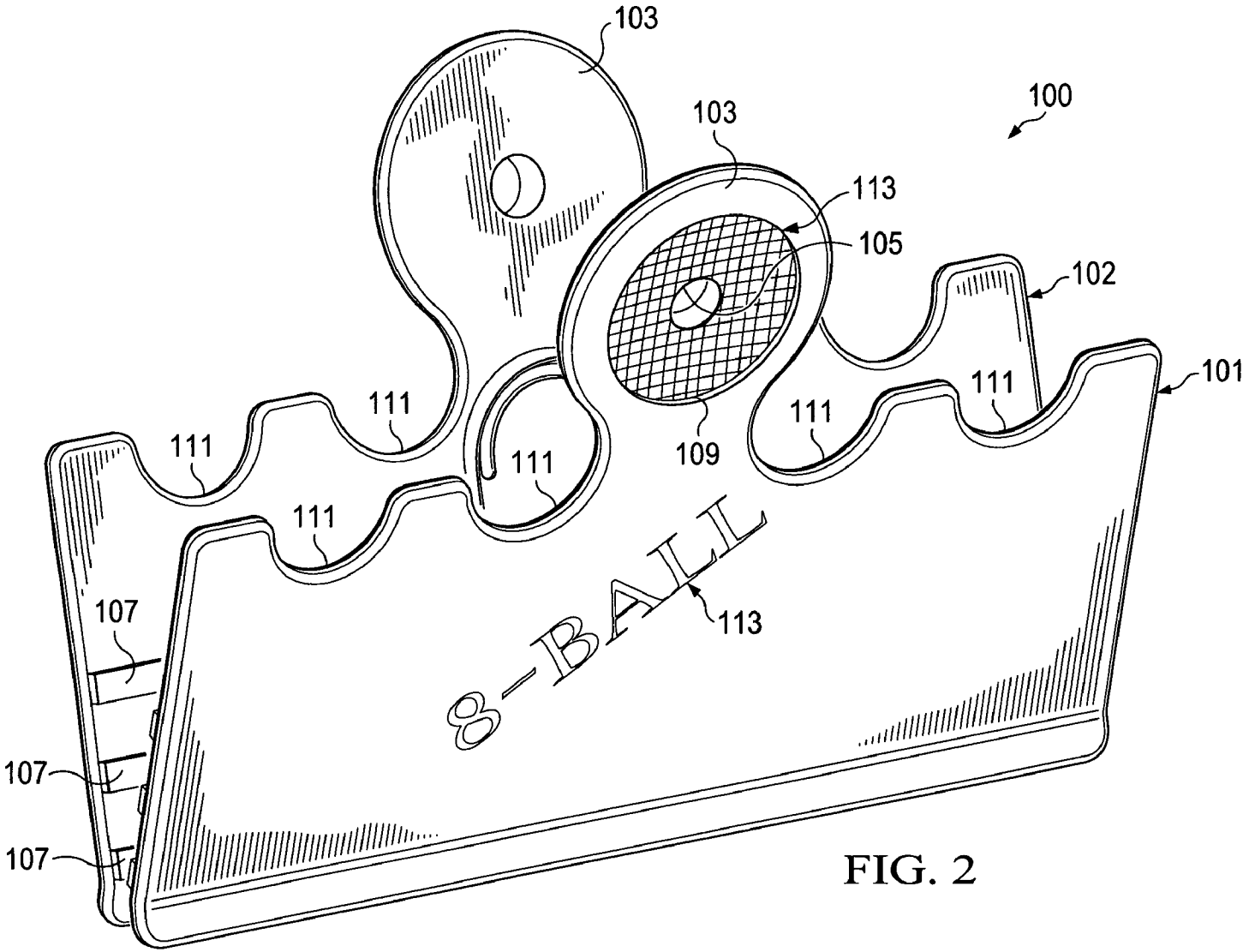
FIG. 2 illustrates a perspective view of the pool clip of the present invention.

FIG. 2 illustrates a perspective view of a first clamp holding member 101 and a second clamp holding member 102 which are pivotally connected together and biased to clamp the support holding surface 107 to a support surface such as a table or counter.

FIG. 2 illustrates that the first clamp holding member 101 and the second clamp holding member 102 are substantially the same construction. The front surface of the clamp holding member 101 includes a handle section 103 to allow the user to depress the first clamp holding member 101 and the second clamp holding member 102 to pivot the first clamp holding member 101 with respect to the second clamp holding member 102 in order to release or a grasp the support surface to which the pool clip 100 will be detachably connected. The handle section 103 of the first clamp holding member 101 or the second clamp holding member 102 is substantially centered and extends in the traverse direction. The handle section 103 includes an aperture 105 which extends through the handle section 103, and the aperture 105 cooperates with an insert member 113 which includes a depression area 109 which may be circular, oval or any other shape in order to accept a cue ball or personal cue ball to provide a resting position for the cue ball. FIG. 2 additionally illustrates the support holding surface 107 on the backside of the first clamp holding member 101 and on the backside of the second clamp holding member 102 which may be formed from flexible material in order to increase the friction between the support surface and the clamp holding member 101, 102. FIG. 2 further illustrates a billiard cue holding surface on the first clamp holding member 101 and the second clamp holding member 102 opposite to the support holding surface 107 which is shown as being concave curved in order to cooperate and clamp the billiard cue 115 which is shown in FIG. 1. The billiard cue 115 is cooperatively claimed by the opposing billiard cue holding surface 111 of the opposing second clamp holding member 102.

Figure 3:
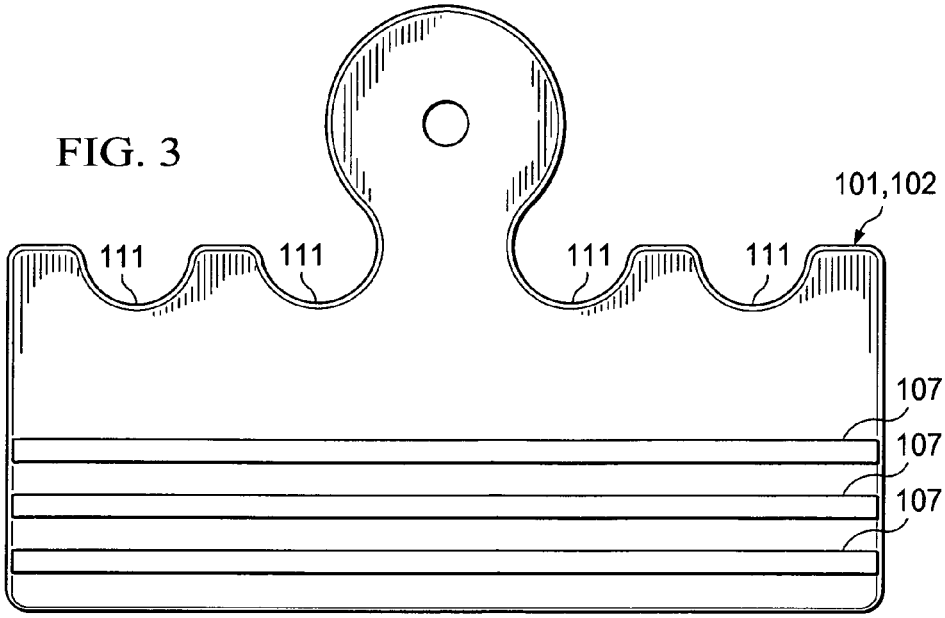
FIG. 3 illustrates a back view of the clamp holding member of the pool clip of the present invention.

FIG. 3 illustrates the backside of the clamp holding member 101, 102 and shows the support holding surface 107 and the billiard cue holding surface 111.

Figure 4:
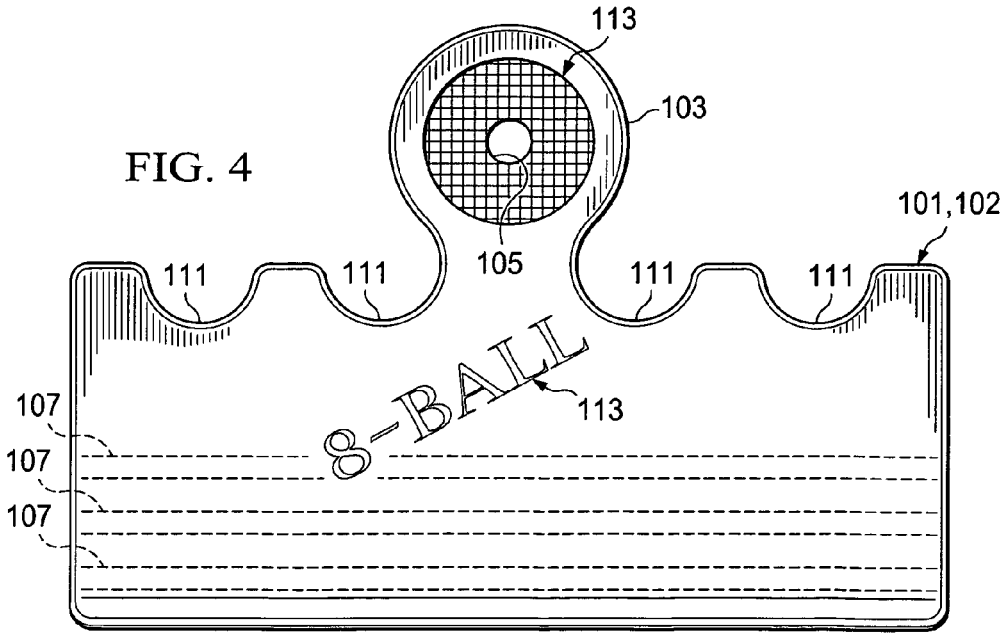
FIG. 4 illustrates a front view of the clamp holding member of the pool clip of the present invention.

FIG. 4 illustrates the front side of the clamp holding member 101, 102 and shows the support holding surface 107 and the billiard cue holding surface 111.

Figure 5:
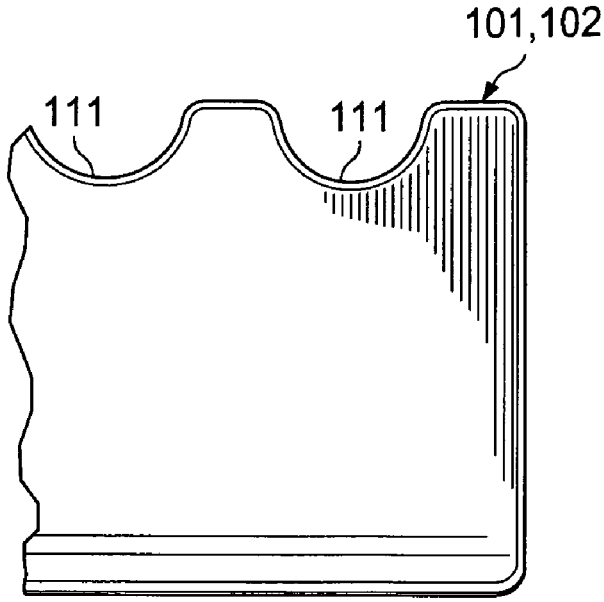
FIG. 5 illustrates a sectional of the clamp holding member of the pool clip of the present invention.

FIG. 5 illustrates a sectional view of the billiard cue holding surface 111.

Figure 6:
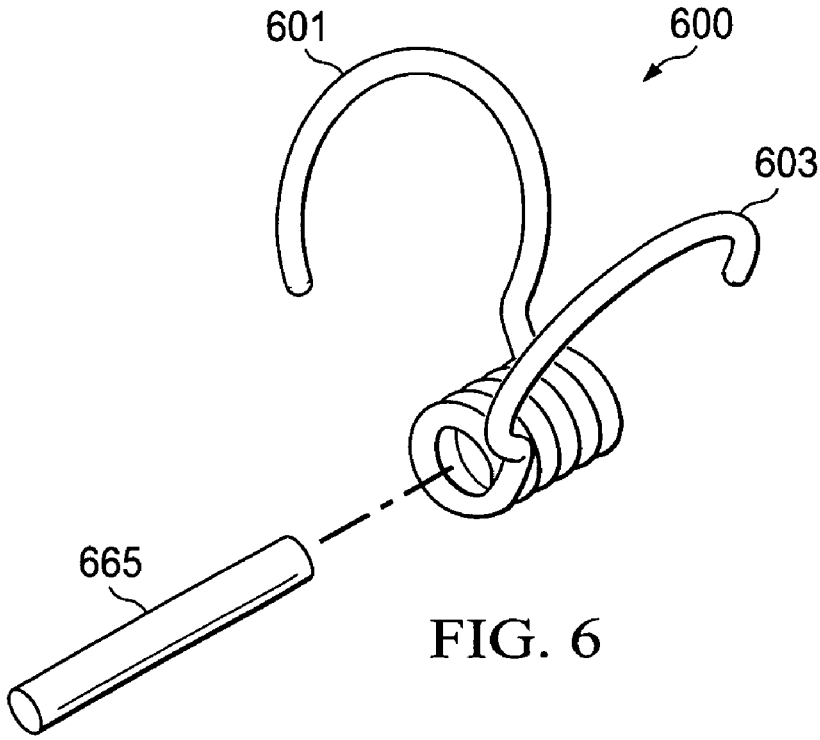
FIG. 6 illustrates a perspective view of a biasing device to bias the clamp holding member of the present invention.

FIG. 6 illustrates the biasing member 600 which includes a first hook shaped member 601 and a second hook shaped member 603 which is opposed to the first hook shape member 601. The biasing member 600 cooperates with a shaft 665 which attaches to arm members 771 as shown in FIG. 7 of the first clamp holding member 101 and the second clamp holding member 102.

Figure 7:
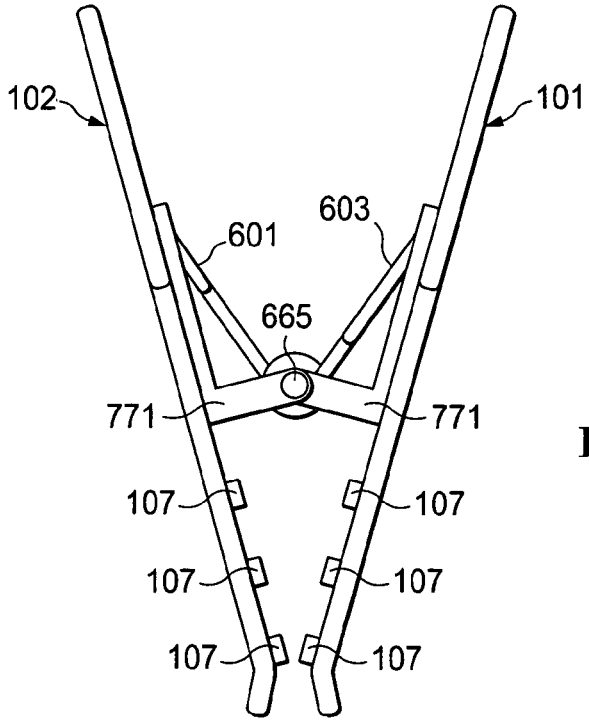
FIG. 7 illustrates a side view of the pool clip of the present invention.

FIG. 7 illustrates a side view of the pool clip 100 and illustrates the first clamp holding member 101 and the second clamp holding member 102. Each of the first clamp holding member 101 and the second clamp holding member 102 includes a pair of arm members 771 which extend out from the clamp holding member 101, 102 and cooperate with the opposing arm members 771 and the shaft 665 to allow the first clamp holding member 101 and the second clamp holding member 102 to pivot with respect to each other. FIG. 7 additionally illustrates the first hook shaped member 601 and the second hook shaped member 603 which cooperate with the first clamp holding member 101 and the second clamp holding member 102 to apply a bias to maintain the pool clip 100 in a closed position so that the support holding surface 107 of each of the first clamp holding member 101 and the second clamp holding member 102 are positioned adjacent. The user applies pressure to the handle section 103 of the first clamp holding member 101 and the second clamp holding member 102 to open the pool clip 100 to engage a support surface. At which time, the bias of the bias device 600 holds the support holding surface 107 to the support surface.

Figure 8:
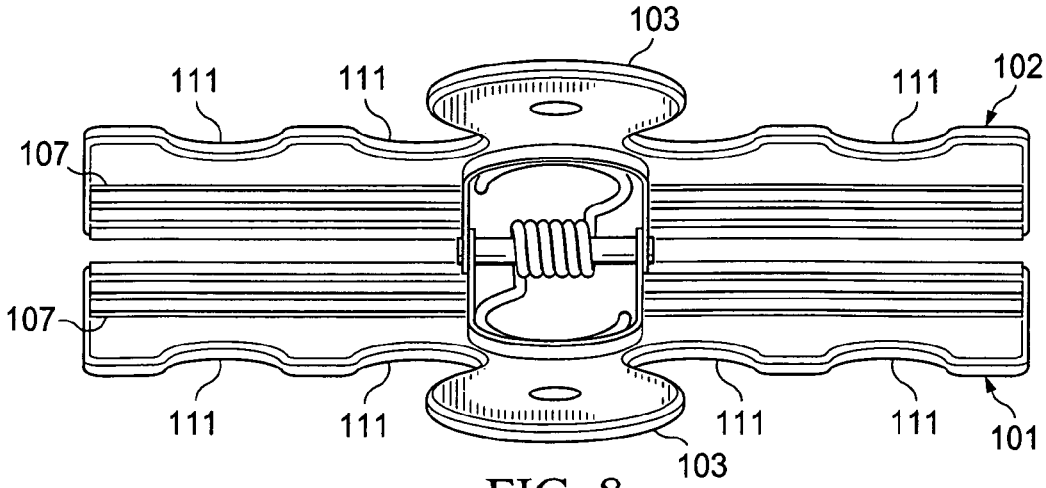
FIG. 8 illustrates a top view of the pool clip of the present invention.

FIG. 8 illustrates a top view of the poor clip 100.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A portable cue stick holding apparatus for detachable connection to a support surface, the apparatus comprising:

first and second cue stick holding members each including a handle section, a support surface gripping section, a cue stick receiving section and first and second arm members, the cue stick holding members integrally formed such that the cue stick receiving section of each cue stick holding member is positioned between the handle section and the support surface gripping section such that the handle section extends outwardly of the cue stick receiving section, the handle section comprising an inlay at an inner portion of the handle section, the handle section and inlay forming an aperture to receive a pool ball, the inlay supporting the pool ball in a substantially stationary position when the aperture receives the pool ball, the inlay being formed from a different material than an outer portion of the handle section;

a pivot member that couples the first arm member of the first cue stick holding member with the first arm member of the second cue stick holding member and that couples the second arm member of the first cue stick holding member with the second arm member of the second cue stick holding member such that movement of the handle sections of the first and second cue stick holding members toward one another causes movement of the support surface gripping section of the first and second cue stick holding members away from one another, wherein the handle sections are movable into a plurality of positions relative to one another, the plurality of positions including a pool ball resting position, wherein at least one of the handle sections is in the pool ball resting position when the portable cue stick holding apparatus is clamped to the support surface, and wherein at least one of the handle sections is in an approximately horizontal plane to provide a resting surface for the pool ball when the handle section is in the pool ball resting position; and a biasing member positioned between the first and second cue stick holding members, the biasing member biasing the handle sections of the first and second cue stick holding members away from one another, thereby biasing the support surface gripping sections of the first and second cue stick holding members toward one another.

2. The portable cue stick holding apparatus as recited in claim 1 wherein each of the support surface gripping sections includes at least one flexible gripping surface.

3. The portable cue stick holding apparatus as recited in claim 1 wherein each of the cue stick receiving sections includes a flexible receiving surface.

4. The portable cue stick holding apparatus as recited in claim 1 wherein each of the cue stick receiving sections includes at least one receiving surface on a first side of the respective handle section and at least one receiving surface on a second side of the respective handle section.

5. The portable cue stick holding apparatus as recited in claim 1 wherein each of the cue stick receiving sections includes at least two receiving surfaces on a first side of the respective handle section and at least two receiving surfaces on a second side of the respective handle section.

6. The portable cue stick holding apparatus as recited in claim 1 wherein the first and second arm members of the first and second cue stick holding members are positioned adjacent to the respective cue stick receiving sections.

7. The portable cue stick holding apparatus as recited in claim 1 wherein the pivot member further comprises a pin that extends through each of the first and second arm members of the first and second cue stick holding members.

8. The portable cue stick holding apparatus as recited in claim 1 wherein the biasing member further comprises a pair of hooks, each of which engages one of the first and second cue stick holding members and is at least partially positioned adjacent to the respective handle section.

9. The portable cue stick holding apparatus as recited in claim 1, wherein the handle portion and the aperture are each one of a circular or oval shape.

10. A portable cue stick holding apparatus for detachable connection to a support surface, the apparatus comprising:

first and second cue stick holding members each including a handle section, a support surface gripping section, a cue stick receiving section and first and second arm members, the cue stick holding members integrally formed such that the cue stick receiving section of each cue stick holding member is positioned between the handle section and the support surface gripping section such that the handle section extends outwardly of the cue stick receiving section, each cue stick receiving section having at least two receiving surfaces on a first side of the handle section and at least two receiving surfaces on a second side of the handle section, the handle section comprising an inlay at an inner portion of the handle section, the inlay forming an aperture to receive a pool ball, the inlay supporting the pool ball in a substantially stationary position when the aperture receives the pool ball, the inlay being formed from a different material than an outer portion of the handle section;

a pivot member that couples the first arm members of the first and second cue stick holding member and that couples the second arm members of the first and second cue stick holding member such that movement of the handle sections of the first and second cue stick holding members toward one another causes movement of the support surface gripping section of the first and second cue stick holding members away from one another, wherein the handle sections are movable into a plurality of positions relative to one another, the plurality of positions including a pool ball resting position, wherein at least one of the handle sections is in the pool ball resting position when the portable cue stick holding apparatus is clamped to the support surface, and wherein at least one of the handle sections is in an approximately horizontal plane to provide a resting surface for the pool ball when the handle section is in the pool ball resting position; and a biasing member positioned between the first and second cue stick holding members, the biasing member biasing the handle sections of the first and second cue stick holding members away from one another, thereby biasing the support surface gripping sections of the first and second cue stick holding members toward one another.

11. The portable cue stick holding apparatus as recited in claim 10 wherein each of the support surface gripping sections includes at least one flexible gripping surface.

12. The portable cue stick holding apparatus as recited in claim 10 wherein each of the cue stick receiving sections includes a flexible receiving surface.

13. The portable cue stick holding apparatus as recited in claim 10 wherein the first and second arm members of the first and second cue stick holding members are positioned adjacent to the respective cue stick receiving sections.

14. The portable cue stick holding apparatus as recited in claim 10 wherein the biasing member further comprises a pair of hooks, each of which engages one of the first and second cue stick holding members and is at least partially positioned adjacent to the respective handle section.

15. The portable cue stick holding apparatus as recited in claim 10, wherein the handle portion and the aperture are each one of a circular or oval shape.

16. A portable cue stick holding apparatus for detachable connection to a support surface, the apparatus comprising:

first and second cue stick holding members each including a handle section, a support surface gripping section, a cue stick receiving section and first and second arm members, the cue stick holding members integrally formed such that the cue stick receiving section of each cue stick holding member is positioned between the handle section and the support surface gripping section such that the handle section extends outwardly of the cue stick receiving section, each cue stick receiving section having at least two receiving surfaces on a first side of the handle section and at least two receiving surfaces on a second side of the handle section, the handle section comprising an inlay at an inner portion of the handle section, the inlay forming an aperture to receive a pool ball, the inlay supporting the pool ball in a substantially stationary position when the aperture receives the pool ball, the inlay being formed from a different material than an outer portion of the handle section;

a pivot member that couples the first arm members of the first and second cue stick holding member and that couples the second arm members of the first and second cue stick holding member such that movement of the handle sections of the first and second cue stick holding members toward one another causes movement of the support surface gripping section of the first and second cue stick holding members away from one another, wherein the handle sections are movable into a plurality of positions relative to one another, the plurality of positions including a pool ball resting position, wherein at least one of the handle sections is in the pool ball resting position when the portable cue stick holding apparatus is clamped to the support surface, and wherein at least one of the handle sections is in an approximately horizontal plane to provide a resting surface for the pool ball when the handle section is in the pool ball resting position; and a biasing member positioned between the first and second cue stick holding members, the biasing member biasing the handle sections of the first and second cue stick holding members away from one another, thereby biasing the support surface gripping sections of the first and second cue stick holding members toward one another.

17. The portable cue stick holding apparatus as recited in claim 16 wherein each of the support surface gripping sections includes at least one flexible gripping surface.

18. The portable cue stick holding apparatus as recited in claim 16 wherein each of the cue stick receiving sections includes a flexible receiving surface.

19. The portable cue stick holding apparatus as recited in claim 16 wherein the first and second arm members of the first and second cue stick holding members are positioned adjacent to the respective cue stick receiving sections.

20. The portable cue stick holding apparatus as recited in claim 16 wherein the biasing member further comprises a pair of hooks, each of which engages one of the first and second cue stick holding members and is at least partially positioned adjacent to the respective handle section.

* * * * *